US011229235B2

(12) United States Patent
Saygili et al.

(10) Patent No.: US 11,229,235 B2
(45) Date of Patent: Jan. 25, 2022

(54) AEROSOL-GENERATING SYSTEM WITH CONCEALED VENTILATION AIRFLOW

(71) Applicant: Philip Morris Products S.A., Neuchatel (CH)

(72) Inventors: Ali Murat Saygili, Neuchatel (CH); Irene Taurino, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 107 days.

(21) Appl. No.: 16/627,463

(22) PCT Filed: Jul. 13, 2018

(86) PCT No.: PCT/EP2018/069164
§ 371 (c)(1),
(2) Date: Dec. 30, 2019

(87) PCT Pub. No.: WO2019/012145
PCT Pub. Date: Jan. 17, 2019

(65) Prior Publication Data

US 2020/0221777 A1 Jul. 16, 2020

(30) Foreign Application Priority Data

Jul. 14, 2017 (EP) ..... 17181538

(51) Int. Cl.
*A24F 13/00* (2006.01)
*A24F 40/30* (2020.01)
(Continued)

(52) U.S. Cl.
CPC ..... *A24F 40/30* (2020.01); *A24F 40/10* (2020.01); *A24F 40/42* (2020.01); *A24F 40/465* (2020.01);
(Continued)

(58) Field of Classification Search
CPC ..... A24F 47/00
(Continued)

(56) References Cited

U.S. PATENT DOCUMENTS 10,791,760 B2 * 10/2020 Zuber ..... H05B 3/265
2014/0314397 A1 10/2014 Alima
(Continued)

FOREIGN PATENT DOCUMENTS

RU 2 616 556 C2 2/2016
RU 2 627 004 C2 3/2016
(Continued)

OTHER PUBLICATIONS

International Search Report dated Oct. 18, 2018 in PCT/EP2018/069164 filed on Jul. 13, 2018, 4 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating system is provided, including: a cartridge assembly including a cartridge having an upstream end and a downstream end, and a ventilation air inlet positioned downstream of the cartridge; and an aerosol-generating device including a housing defining a device cavity configured to receive an upstream end of the cartridge assembly, an electric heater configured to heat the cartridge when the cartridge assembly is received within the device cavity, a power supply, and a controller configured to control a supply of electrical power from the power supply to the electric heater, the system being configured so that, when the upstream end of the cartridge assembly is received within the device cavity, the ventilation air inlet is positioned within the device cavity and a portion of an internal surface of the
(Continued)

device cavity overlying the ventilation air inlet is spaced apart from the cartridge assembly.

14 Claims, 2 Drawing Sheets

(51) Int. Cl.

| | |
|---|---|
| ***A24F 40/485*** | (2020.01) |
| ***A24F 40/10*** | (2020.01) |
| ***A24F 40/465*** | (2020.01) |
| ***A24F 40/57*** | (2020.01) |
| ***A24F 40/42*** | (2020.01) |
| *A24F 40/20* | (2020.01) |

(52) U.S. Cl.
CPC ..... *A24F 40/485* (2020.01); *A24F 40/57* (2020.01); *A24F 40/20* (2020.01)

(58) Field of Classification Search
USPC ..... 131/328–329
See application file for complete search history.

(56) References Cited

U.S. PATENT DOCUMENTS

| | | | |
|---|---|---|---|
| 2017/0095002 | A1 | 4/2017 | Silvestrini |
| 2018/0228216 | A1 | 8/2018 | Saygili |

FOREIGN PATENT DOCUMENTS

| | | | |
|---|---|---|---|
| WO | WO 2013/083635 | A1 | 6/2013 |
| WO | WO 2015/197627 | A1 | 12/2015 |
| WO | WO 2017/032695 | A1 | 3/2017 |
| WO | WO 2017/108721 | A1 | 6/2017 |

OTHER PUBLICATIONS

Written Opinion of the International Searching Authority dated Oct. 18, 2018 in PCT/EP2018/069164 filed on Jul. 13, 2018.
Russian Decision to Grant and Search Report dated Nov. 2, 2021 in corresponding Russian Patent Application No. 2020106123 (with English translation), 20 pages.

* cited by examiner

AEROSOL-GENERATING SYSTEM WITH CONCEALED VENTILATION AIRFLOW

CROSS-REFERENCE TO RELATED APPLICATIONS

This application is a U.S. national stage application of PCT/EP2018/069164, filed on Jul. 13, 2018, which is based upon and claims the benefit of priority from European patent application no. 17181538.4, filed Jul. 14, 2017, the entire contents of each of which are incorporated herein by reference.

TECHNICAL FIELD

The present invention relates to an aerosol-generating system comprising a cartridge assembly and configured for ventilation airflow into the cartridge assembly. Particularly preferred embodiments of the invention relate to an aerosol-generating system comprising a nicotine source and an acid source for the in situ generation of an aerosol comprising nicotine salt particles.

DESCRIPTION OF THE RELATED ART

Devices for generating and delivering aerosols to a user are known, including devices for delivering nicotine to a user. Known systems for delivering aerosols to a user may include one or more inlets for introducing ventilation air into the device. In this context, ventilation air is airflow that passes through the system in a manner that bypasses the aerosol-generating section of the system. Therefore, ventilation air dilutes the mainstream airflow containing the generated aerosol to provide a desired concentration of aerosol to the user.

However, typically, known devices have included ventilation air inlets without considering the effect of ventilation air on the quality of the aerosol delivered to a user and how positioning ventilation air inlets may affect usability of the device. It would be desirable to provide an aerosol-generating system that addresses at least these issues with known devices.

SUMMARY

According to the present invention there is provided an aerosol-generating system comprising a cartridge assembly and an aerosol-generating device. The cartridge assembly comprises a cartridge having an upstream end and a downstream end. The cartridge comprises a first compartment having a first air inlet at the upstream end of the cartridge and a first air outlet at the downstream end of the cartridge. The cartridge also comprises a second compartment having a second air inlet at the upstream end of the cartridge and a second air outlet at the downstream end of the cartridge. The cartridge assembly further comprises a mouthpiece connected to the cartridge, the mouthpiece comprising a mouthpiece air outlet. The cartridge assembly also comprises a mixing chamber extending between the downstream end of the cartridge and the mouthpiece air outlet, and a ventilation air inlet positioned downstream of the cartridge and providing fluid communication between an exterior of the cartridge assembly and the mixing chamber. The aerosol-generating device comprises a housing defining a device cavity for receiving an upstream end of the cartridge assembly, and an electric heater for heating the cartridge when the cartridge assembly is received within the device cavity. The aerosol-generating device also comprises a power supply and a controller configured to control a supply of electrical power from the power supply to the electric heater. The aerosol-generating system is configured so that, when the upstream end of the cartridge assembly is received within the device cavity, the ventilation air inlet is positioned within the device cavity and a portion of an internal surface of the device cavity overlying the ventilation air inlet is spaced apart from the cartridge assembly.

BRIEF DESCRIPTION OF THE DRAWINGS

The invention will be further described, by way of example only, with reference to the accompanying drawings in which.

DETAILED DESCRIPTION

Figure 1:
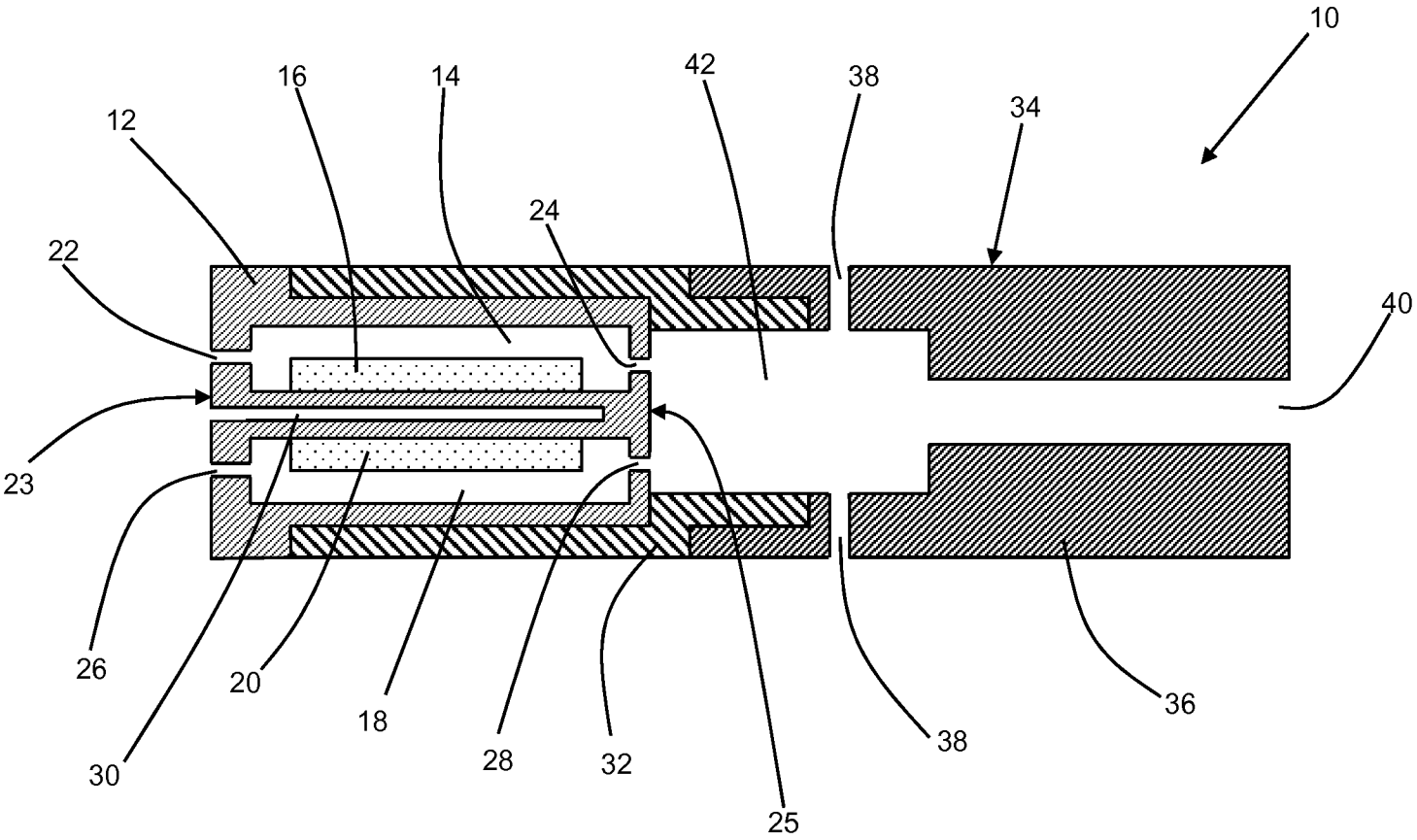
FIG. 1 shows a cross-sectional view of a cartridge assembly of an aerosol-generating system according to an embodiment of the present invention.

As used herein, the terms "upstream" and "downstream" refer to the direction of airflow through the cartridge assembly or components of the cartridge assembly during use of the aerosol-generating system. That is, generally, air flows from an upstream end to a downstream end.

Aerosol-generating systems according to the present invention comprise a ventilation air inlet in a cartridge assembly that is positioned downstream of a cartridge, wherein the ventilation air inlet is positioned within a device cavity when the upstream end of the cartridge assembly is received within the device cavity, and wherein a portion of an internal surface of the device cavity is spaced apart from the ventilation air inlet. The present inventors have recognised that this configuration is particularly advantageous when compared to known aerosol-generating systems.

Firstly, positioning the ventilation air inlet downstream of the cartridge substantially eliminates contact between the ventilation air and the cartridge, which is heated during use. Advantageously, this reduces the temperature of the ventilation air when compared to known systems in which ventilation air enters the system upstream of the cartridge or adjacent to the cartridge and flows across an outer surface of the cartridge before being mixed with mainstream air further downstream. Reducing the temperature of the ventilation air may reduce the overall temperature of the aerosol delivered to a user, which may improve the user experience. Reducing the temperature of the ventilation air may facilitate an increase in a heating temperature of the cartridge while maintaining an overall temperature of the aerosol delivered to a user.

Secondly, the aerosol-generating system being configured so that the ventilation air inlet is positioned within the device cavity when the upstream end of the cartridge is received within the device cavity may substantially prevent a user from obscuring the ventilation air inlet when compared to known systems in which a ventilation air inlet is positioned on a portion of a cartridge or a cartridge assembly that may be inadvertently covered by a user's mouth during use of the aerosol-generating system.

Preferably, the ventilation air inlet is positioned within a downstream half of the device cavity when the upstream end of the cartridge assembly is received within the device cavity.

Advantageously, positioning the ventilation air inlet in the downstream half of the device cavity may facilitate spacing the ventilation air inlet from the downstream end of the cartridge, which may minimise the temperature of ventilation air entering the mixing chamber through the ventilation air inlet.

Advantageously, positioning the ventilation air inlet in the downstream half of the device cavity may facilitate increasing the length of the cartridge while maintaining the ventilation air inlet downstream of the cartridge. This may facilitate increasing the length of the first and second compartments, which may increase the capacity of the first and second compartments for storing one or more aerosol-forming substrates, as further described herein.

The device cavity may have a maximum length extending between an upstream end of the device cavity and a downstream end of the device cavity. Preferably, the distance between the ventilation air inlet and the downstream end of the device cavity is less than 50 percent of the maximum length of the device cavity, when the upstream end of the cartridge assembly is received within the device cavity. Preferably, the distance between the ventilation air inlet and the downstream end of the device cavity is less than 40 percent of the maximum length of the device cavity, when the upstream end of the cartridge assembly is received within the device cavity. Preferably, the distance between the ventilation air inlet and the downstream end of the device cavity is less than 30 percent of the maximum length of the device cavity, when the upstream end of the cartridge assembly is received within the device cavity. Preferably, the distance between the ventilation air inlet and the downstream end of the device cavity is less than 25 percent of the maximum length of the device cavity, when the upstream end of the cartridge assembly is received within the device cavity. Preferably, the distance between the ventilation air inlet and the downstream end of the device cavity is less than 20 percent of the maximum length of the device cavity, when the upstream end of the cartridge assembly is received within the device cavity. Preferably, the distance between the ventilation air inlet and the downstream end of the device cavity is less than 10 percent of the maximum length of the device cavity, when the upstream end of the cartridge assembly is received within the device cavity.

Preferably, the ventilation air inlet is defined by the mouthpiece. The mouthpiece may comprise a mouthpiece housing at least partially defining the mixing chamber, wherein the ventilation air inlet extends through the mouthpiece housing. Preferably, the mouthpiece housing defines the mouthpiece air outlet.

The cartridge assembly may comprise a cartridge holder, wherein at least a portion of the cartridge is positioned within the cartridge holder, and wherein at least a portion of the cartridge holder is positioned within the mouthpiece.

Advantageously, the cartridge holder may reduce conductive heat transfer from the cartridge to the mouthpiece during use of the aerosol-generating system. This may further reduce or minimise the temperature of ventilation air entering the mixing chamber through the ventilation air inlet.

The cartridge holder may have a tubular shape. Preferably, at least a downstream end of the cartridge is positioned within the cartridge holder. Preferably, at least a downstream end of the cartridge holder is positioned within the mouthpiece. Preferably, the tubular cartridge holder comprises an open upstream end through which the cartridge is inserted into the tubular cartridge holder during manufacture of the cartridge assembly. Preferably, the tubular cartridge holder comprises an open downstream end to provide fluid communication between the first and second air outlets of the cartridge and the mixing chamber.

A downstream end of the cartridge holder may be positioned upstream of the ventilation air inlet. Advantageously, this may eliminate the need for one or more apertures in the cartridge holder to provide fluid communication between the ventilation air inlet and the mixing chamber.

A portion of the cartridge holder may overlap a portion of the mouthpiece housing comprising the ventilation air inlet, wherein the cartridge holder comprises a ventilation air aperture underlying the ventilation air inlet to provide fluid communication between the ventilation air inlet and the mixing chamber. Advantageously, this configuration may increase or maximise the overlap between the cartridge holder and the mouthpiece, which may facilitate securing the mouthpiece and the cartridge holder together.

The cartridge assembly may comprise a single ventilation air inlet. The cartridge assembly may comprise a plurality of ventilation air inlets. The skilled person can select the number of ventilation air inlets to provide a desired flow of ventilation air into the mixing chamber during use of the aerosol-generating system.

Preferably, the first compartment contains a first aerosol-forming substrate and the second compartment contains a second aerosol-forming substrate.

Preferably, the first compartment contains a nicotine source and the second compartment contains an acid source. As described herein, the configuration of aerosol-generating systems according to the present invention may facilitate a reduction in the temperature of ventilation air entering the mixing chamber. The present inventors have recognised that this is particularly advantageous in embodiments in which the cartridge comprises a nicotine source and an acid source, wherein nicotine and acid vapours are mixed in the mixing chamber to form nicotine salt particles for delivery to a user. In particular, the present inventors have recognised that reducing the temperature of the ventilation air entering the mixing chamber reduces the mean size of the nicotine salt particles formed within the mixing chamber, which advantageously reduces the harshness of the aerosol perceived by a user. Specifically, mixing ventilation air entering the mixing chamber at a temperature of below 50 degrees Celsius with nicotine and acid vapours both entering the mixing chamber at a temperature of approximately 80 degrees Celsius results in a significant reduction in nicotine salt particles having a diameter of over 2 micrometres, which yields the reduction in perceived harshness.

The nicotine source may comprise a first carrier material impregnated with between about 1 milligram and about 50 milligrams of nicotine. The nicotine source may comprise a first carrier material impregnated with between about 1 milligram and about 40 milligrams of nicotine. Preferably, the nicotine source comprises a first carrier material impregnated with between about 3 milligrams and about 30 milligrams of nicotine. More preferably, the nicotine source comprises a first carrier material impregnated with between about 6 milligrams and about 20 milligrams of nicotine. Most preferably, the nicotine source comprises a first carrier material impregnated with between about 8 milligrams and about 18 milligrams of nicotine.

The first carrier material may be impregnated with liquid nicotine or a solution of nicotine in an aqueous or non-aqueous solvent.

The first carrier material may be impregnated with natural nicotine or synthetic nicotine.

The acid source may comprise an organic acid or an inorganic acid.

Preferably, the acid source comprises an organic acid, more preferably a carboxylic acid, most preferably an alpha-keto or 2-oxo acid or lactic acid.

Advantageously, the acid source comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. Advantageously, the acid source comprises pyruvic acid or lactic acid. More advantageously, the acid source comprises lactic acid.

Advantageously, the acid source comprises a second carrier material impregnated with acid.

The first carrier material and the second carrier material may be the same or different.

Advantageously, the first carrier material and the second carrier material have a density of between about 0.1 grams/cubic centimetre and about 0.3 grams/cubic centimetre.

Advantageously, the first carrier material and the second carrier material have a porosity of between about 15 percent and about 55 percent.

The first carrier material and the second carrier material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

The first carrier material acts as a reservoir for the nicotine.

Advantageously, the first carrier material is chemically inert with respect to nicotine.

The first carrier material may have any suitable shape and size. For example, the first carrier material may be in the form of a sheet or plug.

Advantageously, the shape and size of the first carrier material is similar to the shape and size of the first compartment of the cartridge.

The shape, size, density and porosity of the first carrier material may be chosen to allow the first carrier material to be impregnated with a desired amount of nicotine.

Advantageously, the first compartment of the cartridge may further comprise a flavourant. Suitable flavourants include, but are not limited to, menthol.

Advantageously, the first carrier material may be impregnated with between about 3 milligrams and about 12 milligrams of flavourant.

The second carrier material acts as a reservoir for the acid.

Advantageously, the second carrier material is chemically inert with respect to the acid.

The second carrier material may have any suitable shape and size. For example, the second carrier material may be in the form of a sheet or plug.

Advantageously, the shape and size of the second carrier material is similar to the shape and size of the second compartment of the cartridge.

The shape, size, density and porosity of the second carrier material may be chosen to allow the second carrier material to be impregnated with a desired amount of acid.

Advantageously, acid source is a lactic acid source comprising a second carrier material impregnated with between about 2 milligrams and about 60 milligrams of lactic acid.

Preferably, the lactic acid source comprises a second carrier material impregnated with between about 5 milligrams and about 50 milligrams of lactic acid. More preferably, the lactic acid source comprises a second carrier material impregnated with between about 8 milligrams and about 40 milligrams of lactic acid. Most preferably, the lactic acid source comprises a second carrier material impregnated with between about 10 milligrams and about 30 milligrams of lactic acid.

The shape and dimensions of the first compartment of the cartridge may be chosen to allow a desired amount of nicotine to be housed in the cartridge.

The shape and dimensions of the second compartment of the cartridge may be chosen to allow a desired amount of acid to be housed in the cartridge.

The ratio of nicotine and acid required to achieve an appropriate reaction stoichiometry may be controlled and balanced through variation of the volume of the first compartment relative to the volume of the second compartment.

The first air inlet of the first compartment of the cartridge and the second air inlet of the second compartment of the cartridge may each comprise one or more apertures. For example, the first air inlet of the first compartment of the cartridge and the second air inlet of the second compartment of the cartridge may each comprise one, two, three, four, five, six or seven apertures.

The first air inlet of the first compartment of the cartridge and the second air inlet of the second compartment of the cartridge may comprise the same or different numbers of apertures.

Advantageously, the first air inlet and the second air inlet each comprise a plurality of apertures. For example, the first air inlet and the second air inlet may each comprise two, three, four, five, six or seven apertures.

Providing a first air inlet comprising a plurality of apertures and a second air inlet comprising a plurality of apertures may advantageously result in more homogeneous airflow within the first compartment and the second compartment, respectively. In use, this may improve entrainment of nicotine in an air stream drawn through the first compartment and improve entrainment of acid in an air stream drawn through the second compartment.

The ratio of nicotine and acid required to achieve an appropriate reaction stoichiometry may be controlled and balanced through variation of the volumetric airflow through the first compartment relative to the volumetric airflow through the second compartment. The ratio of the volumetric airflow through the first compartment relative to the volumetric airflow through the second compartment may be controlled through variation of one or more of the number, dimensions and location of the apertures forming the first air inlet of the first compartment relative to the number, dimensions and location of the apertures forming the second air inlet of the second compartment.

In embodiments in which the acid source comprises lactic acid, advantageously the flow area of the second air inlet of the second compartment is greater than the flow area of the first air inlet of the first compartment.

As used herein with reference to the invention, the term "flow area" is used to describe the cross-sectional area of an air inlet or air outlet through which air flows during use. In embodiments in which an air inlet or air outlet comprises a plurality of apertures, the flow area of the air inlet or air outlet is the total flow area of the air inlet or air outlet and is equal to the sum of the flow areas of each of the plurality of apertures forming the air inlet or air outlet. In embodiments in which the cross-sectional area of an air inlet or air outlet varies in the direction of airflow, the flow area of the air inlet or air outlet is the minimum cross-sectional area in the direction of airflow.

The first air outlet of the first compartment of the cartridge and the second air outlet of the second compartment of the cartridge may each comprise one or more apertures. For example, the first air outlet and the second air outlet may each comprise one, two, three, four, five, six or seven apertures.

The first air outlet and the second air outlet may comprise the same or different numbers of apertures.

Advantageously, the first air outlet and the second air outlet may each comprise a plurality of apertures. For example, the first air outlet and the second air outlet may each comprise two, three, four, five, six or seven apertures. Providing a first air outlet comprising a plurality of apertures and a second air outlet comprising a plurality of apertures may advantageously result in more homogeneous airflow within the first compartment and the second compartment, respectively. In use, this may improve entrainment of nicotine in an air stream drawn through the first compartment and improve entrainment of acid in an air stream drawn through the second compartment.

In embodiments in which the first air outlet comprises a plurality of apertures, advantageously the first air outlet comprises between 2 and 5 apertures.

In embodiments in which the second air outlet comprises a plurality of apertures, advantageously, the second air outlet comprises between 3 and 7 apertures.

Advantageously, the first air outlet and the second air outlet may each comprise a single aperture, which may advantageously simplify manufacturing of the cartridge.

The ratio of nicotine and acid required to achieve an appropriate reaction stoichiometry may be controlled and balanced through variation of the volumetric airflow through the first compartment relative to the volumetric airflow through the second compartment. The ratio of the volumetric airflow through the first compartment relative to the volumetric airflow through the second compartment may be controlled through variation of one or more of the number, dimensions and location of the apertures forming the first air outlet relative to the number, dimensions and location of the apertures forming the second air outlet.

The flow area of the first air outlet may be the same as or different to the flow area of the second air outlet.

The flow area of the second air outlet may be greater than flow area of the first air outlet.

Increasing the flow area of the second air outlet relative to the flow area of the first air outlet may advantageously increase the volumetric airflow through the second air outlet compared to the volumetric airflow through the first air outlet.

The cartridge assembly may comprise one or more aerosol-modifying agents positioned within the mouthpiece. For example, the mouthpiece may contain one or more sorbents, one or more flavourants, one or more chemesthetic agents or a combination thereof.

The cartridge, the mouthpiece, and the cartridge holder where present may be formed from any suitable material or combination of materials. Suitable materials include, but are not limited to, aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), epoxy resins, polyurethane resins, vinyl resins, liquid crystal polymers (LCP) and modified LCPs, such as LCPs with graphite or glass fibres.

The cartridge, the mouthpiece, and the cartridge holder where present may be formed from the same or different materials.

The cartridge may be formed from one or more materials that are nicotine-resistant and acid-resistant.

The first compartment may be coated with one or more nicotine-resistant materials and the second compartment may be coated with one or more acid-resistant materials.

Examples of suitable nicotine-resistant materials and acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more nicotine-resistant materials may advantageously enhance the shelf life of the cartridge assembly.

Use of one or more acid-resistant materials may advantageously enhance the shelf life of the cartridge assembly.

Preferably, the aerosol-generating device at least partially defines at least one system air inlet, the at least one system air inlet providing fluid communication between the exterior of the aerosol-generating system and each of the first air inlet, the second air inlet and the ventilation air inlet. The downstream end of the device cavity may at least partially define the at least one system air inlet. That is, the aerosol-generating system may be configured such that air enters the aerosol-generating system through the downstream end of the device cavity during use. The at least one system air inlet may be define by a gap between the cartridge assembly and the downstream end of the device cavity when the upstream end of the cartridge assembly is received within the device cavity.

The at least one system air inlet may comprise a common system air inlet providing fluid communication between the exterior of the aerosol-generating system and each of the first air inlet, the second air inlet and the ventilation air inlet. A portion of the cartridge assembly may be spaced apart from an inner surface of the device cavity when the upstream end of the cartridge assembly is received within the device cavity to define the common system air inlet.

The at least one system air inlet may comprise a first system air inlet providing fluid communication between the exterior of the aerosol-generating system and the ventilation air inlet, and a second system air inlet providing fluid communication between the exterior of the aerosol-generating system and each of the first air inlet and the second air inlet. The gap between the ventilation air inlet and the portion of the internal surface of the device cavity overlying the ventilation air inlet may form the first system air inlet. The second system air inlet may comprise an aperture extending through the device housing and in fluid communication with an upstream end of the device cavity.

Preferably, the aerosol-generating system is configured so that, during use, the electric heater heats the first compartment and the second compartment to between about 60 degrees Celsius and about 100 degrees Celsius, more preferably between about 70 degrees Celsius and about 90 degrees Celsius, most preferably about 80 degrees Celsius.

Preferably, the aerosol-generating system is configured so that, during use, ventilation air enters the mixing chamber through the ventilation air inlet at a temperature of less than about 50 degrees Celsius.

The electric heater may comprise a resistive heater. The resistive heater may extend into the device cavity from an upstream end of the device cavity. Preferably, the cartridge comprises a third compartment positioned between the first compartment and the second compartment, wherein the third compartment is configured to receive the resistive heater when the upstream end of the cartridge assembly is received within the device cavity. During use, the controller controls the supply of electrical power from the power supply to the resistive heater to heat the first compartment and the second compartment.

The electric heater may comprise an inductive heating element. Preferably, the cartridge comprises a third compartment positioned between the first compartment and the second compartment, wherein the cartridge comprises a susceptor material positioned within the third compartment. During use, the controller controls the supply of electrical power from the power supply to the inductive heating element to inductively heat the susceptor material, which then heats the first compartment and the second compartment.

The inductive heating element may comprise at least one induction coil extending around at least a portion of the device cavity. The induction coil may extend completely around the device cavity. The induction coil may be wound around the device cavity with a plurality of windings.

The inductive heating element may comprise at least one planar induction coil. Preferably, each planar induction coil comprises a flat spiral induction coil.

As used herein a "flat spiral induction coil" means a coil that is generally planar, wherein the axis of winding of the coil is normal to the surface in which the coil lies. In some embodiments, the flat spiral coil may be planar in the sense that it lies in a flat Euclidean plane. However, the term "flat spiral induction coil" as used herein covers coils that are shaped to conform to a curved plane or other three dimensional surface. For example, a flat spiral coil may be shaped to conform to a cylindrical housing or cavity of the device. The flat spiral coil can then be said to be planar but conforming to a cylindrical plane, with the axis of winding of the coil normal to the cylindrical plane at the centre of the coil. If the flat spiral coil conforms to a cylindrical plane or non-Euclidian plane, preferably, the flat spiral coil lies in a plane having a radius of curvature in the region of the flat spiral coil greater than a diameter of the flat spiral coil.

In embodiments in which the cartridge comprises a third compartment, preferably the third compartment has an open upstream end and a closed downstream end.

The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

FIG. 1 shows a cartridge assembly 10 of an aerosol-generating system according to an embodiment of the present invention.

The cartridge assembly 10 comprises a cartridge 12 defining a first compartment 14 containing a first aerosol-forming substrate 16 and a second compartment 18 containing a second aerosol-forming substrate 20. The first aerosol-forming substrate 16 comprises a nicotine source and the second aerosol-forming substrate 20 comprises an acid source. The first compartment 14 comprises a first air inlet 22 at an upstream end 23 of the cartridge 12 and a first air outlet 24 at a downstream end 25 of the cartridge 12. The second compartment 18 comprises a second air inlet 26 and a second air outlet 28.

The cartridge 12 also defines a third compartment 30 positioned between the first and second compartments 14, 18. The third compartment 30 is open at its upstream end and closed at its downstream end.

The cartridge assembly 10 further comprises a cartridge holder 32 in which a downstream end of the cartridge 12 is received by an interference fit. The cartridge assembly 10 also comprises a mouthpiece 34 in which a downstream end of the cartridge holder 32 is received by an interference fit.

The mouthpiece 34 comprises mouthpiece housing 36 defining a plurality of ventilation air inlets 38 and a mouthpiece air outlet 40. A mixing chamber 42 is defined between the downstream end 25 of the cartridge 12 and the mouthpiece air outlet 40, wherein the ventilation air inlets 38 are in fluid communication with the mixing chamber 42.

Figure 2:
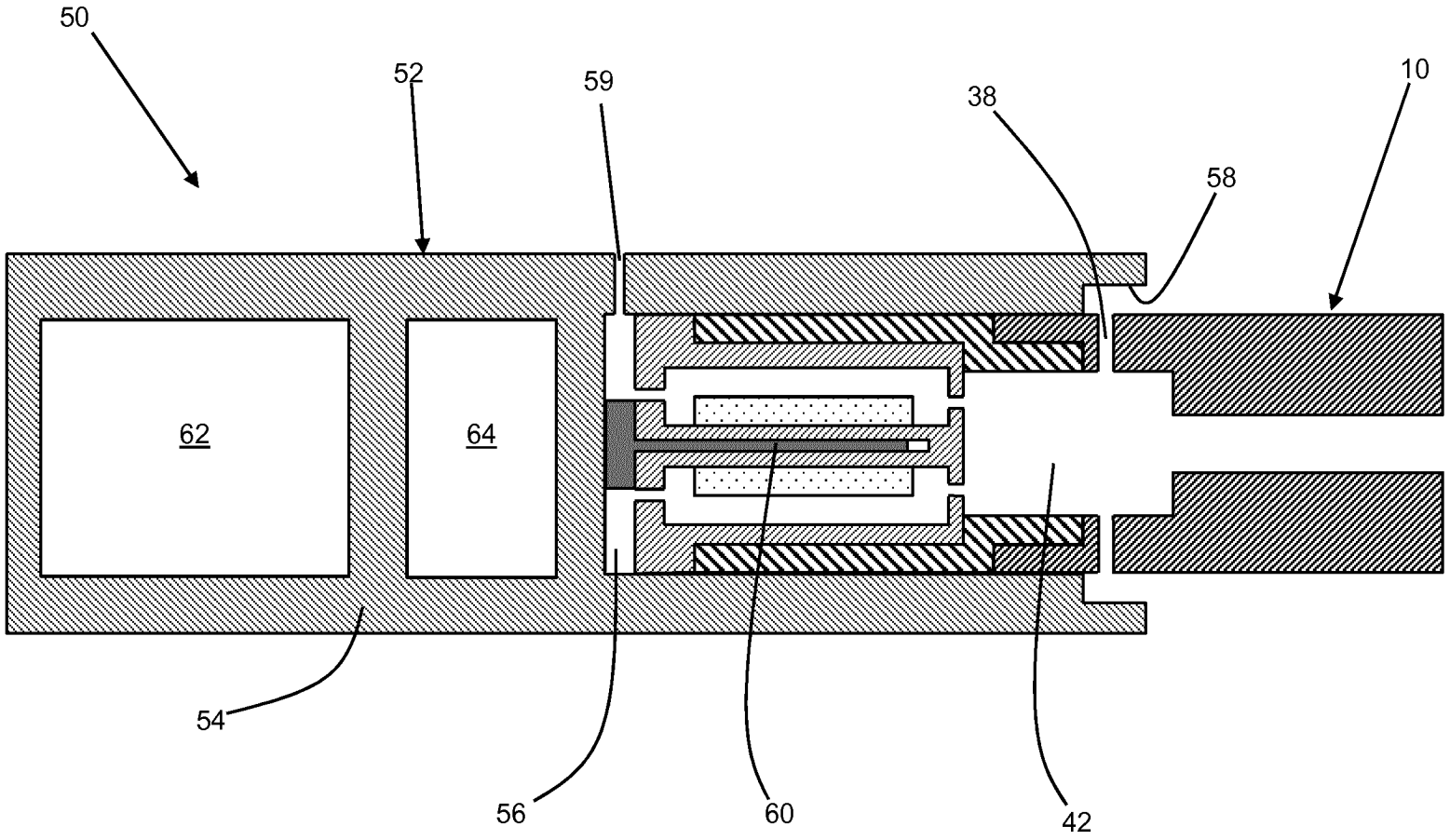
FIG. 2 shows a cross-sectional view of an aerosol-generating system including the cartridge assembly of FIG. 1.

FIG. 2 shows an aerosol-generating system 50 comprising the cartridge assembly 10 and an aerosol-generating device 52. The aerosol-generating device 52 comprises a device housing 54 that defines a device cavity 56 for receiving an upstream end of the cartridge assembly 10, as shown in FIG. 2. The aerosol-generating system 50 is configured so that, when the upstream end of the cartridge assembly 10 is received within the device cavity 56, the ventilation air inlets 38 are positioned within the device cavity 56 and a portion of an internal surface 58 of the device cavity 56 overlying the ventilation air inlets 38 is spaced apart from the cartridge assembly 10 to allow ventilation air to enter the ventilation air inlet 38 via the device cavity 56. Advantageously, positioning the ventilation air inlets 38 within the device cavity 56 may substantially prevent a user's mouth from obstructing the ventilation air inlets 38 during use of the aerosol-generating system 50.

The aerosol-generating device 52 further comprises a system air inlet 59 to allow mainstream air to enter the upstream end of the device cavity 56 where it enters the first and second compartments 14, 18 through the first and second air inlets 22, 26.

The aerosol-generating device 52 also comprise an electric heater 60, a power supply 62, and a controller 64 for controlling a supply of electrical power from the power supply 62 to the electric heater 60. The electric heater 60 is a resistive heater extending into the device cavity 56 at an upstream end of the device cavity 56. The power supply 62 is a rechargeable battery. When the upstream end of the cartridge assembly 10 is received within the device cavity 56, the electric heater 60 is received within the third compartment 30.

During use of the aerosol-generating system 50, the controller 64 controls a supply of electrical power from the power supply 62 to the electric heater 60 to energize the electric heater 60. The electric heater 60 heats the first and second aerosol-forming substrates 16, 20.

When a user draws on the mouthpiece 34 mainstream air is drawn into the upstream end of the device cavity 56. The mainstream air enters the first and second compartments 14, 18 through the first and second air inlets 22, 26. As the mainstream air flows through the first and second compartments 14, 18, nicotine vapour and acid vapour from the first and second aerosol-forming substrates 16, 20 are entrained in the mainstream air. The mainstream air containing the nicotine vapour and the acid vapour flows into a mixing chamber 42 at the downstream end of the cartridge 12 where the nicotine vapour and the acid vapour react to form nicotine salt particles.

When a user draws on the mouthpiece 34, ventilation air also enters the aerosol-generating system 50. In particular, ventilation air enters the mixing chamber 42 via the downstream end of the device cavity 56 and the ventilation air inlets 38. The cartridge holder 32 insulates the mouthpiece 34 from the heated cartridge 12 so that the ventilation air entering the mixing chamber 42 is at a significantly lower temperature than the nicotine vapour and acid vapour entering the mixing chamber 42 from the cartridge 12.

In the mixing chamber 42, the ventilation air mixes with the nicotine salt particles formed from the nicotine vapour and the acid vapour to form an aerosol for delivery to the user. The aerosol flows out of the mixing chamber 42 via the mouthpiece air outlet 40.

The invention claimed is:

1. An aerosol-generating system, comprising:

a cartridge assembly comprising:

a cartridge having an upstream end and a downstream end, and a ventilation air inlet positioned downstream of the cartridge; and an aerosol-generating device comprising:

a housing defining a device cavity configured to receive an upstream end of the cartridge assembly, an electric heater configured to heat the cartridge when the cartridge assembly is received within the device cavity, a power supply, and a controller configured to control a supply of electrical power from the power supply to the electric heater, wherein the aerosol-generating system is configured so that, when the upstream end of the cartridge assembly is received within the device cavity, the ventilation air inlet is positioned within the device cavity and a portion of an internal surface of the device cavity overlying the ventilation air inlet is spaced apart from the cartridge assembly.

2. The aerosol-generating system according to claim 1, wherein the ventilation air inlet is positioned within a downstream half of the device cavity when the upstream end of the cartridge assembly is received within the device cavity.

3. The aerosol-generating system according to claim 2, wherein the device cavity has a maximum length extending between an upstream end of the device cavity and a downstream end of the device cavity, and wherein a distance between the ventilation air inlet and the downstream end of the device cavity when the upstream end of the cartridge assembly is received within the device cavity is less than 25 percent of a maximum length of the device cavity.

4. The aerosol-generating system according to claim 1, wherein the cartridge assembly further comprises:

a mouthpiece connected to the cartridge, the mouthpiece comprising a mouthpiece air outlet, and a mixing chamber extending between the downstream end of the cartridge and the mouthpiece air outlet, wherein the ventilation air inlet provides fluid communication between an exterior of the cartridge assembly and the mixing chamber.

5. The aerosol-generating system according to claim 4, wherein the mouthpiece further comprises a mouthpiece housing at least partially defining the mixing chamber, and wherein the ventilation air inlet extends through the mouthpiece housing.

6. The aerosol-generating system according to claim 5, wherein the cartridge assembly further comprises a cartridge holder, wherein at least a portion of the cartridge is positioned within the cartridge holder, and wherein at least a portion of the cartridge holder is positioned within the mouthpiece.

7. The aerosol-generating system according to claim 6, wherein a downstream end of the cartridge holder is positioned upstream of the ventilation air inlet.

8. The aerosol-generating system according to claim 6, wherein a portion of the cartridge holder overlaps a portion of the mouthpiece housing comprising the ventilation air inlet, and wherein the cartridge holder comprises a ventilation air aperture underlying the ventilation air inlet to provide fluid communication between the ventilation air inlet and the mixing chamber.

9. The aerosol-generating system according to claim 1, wherein the cartridge comprises:

a first compartment having a first air inlet at the upstream end of the cartridge and a first air outlet at the downstream end of the cartridge, and a second compartment having a second air inlet at the upstream end of the cartridge and a second air outlet at the downstream end of the cartridge.

10. The aerosol-generating system according to claim 9, wherein the first compartment contains a nicotine source and the second compartment contains an acid source.

11. The aerosol-generating system according to claim 9, wherein the electric heater comprises a resistive heater.

12. The aerosol-generating system according to claim 11, wherein the resistive heater extends into the device cavity from an upstream end of the device cavity, wherein the cartridge further comprises a third compartment positioned between the first compartment and the second compartment, and wherein the third compartment is configured to receive the resistive heater when the upstream end of the cartridge assembly is received within the device cavity.

13. The aerosol-generating system according to claim 9, wherein the electric heater comprises an inductive heating element.

14. The aerosol-generating system according to claim 13, wherein the cartridge comprises a third compartment positioned between the first compartment and the second compartment, and a susceptor material positioned within the third compartment.

* * * * *